US009158258B2

(12) United States Patent
Hayakawa et al.

(10) Patent No.: US 9,158,258 B2
(45) Date of Patent: Oct. 13, 2015

(54) IMAGE FORMATION APPARATUS

(71) Applicant: Oki Data Corporation, Tokyo (JP)

(72) Inventors: Yoichi Hayakawa, Tokyo (JP); Masahiro Sonoda, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/138,173

(22) Filed: Dec. 23, 2013

(65) Prior Publication Data

US 2014/0186061 A1 Jul. 3, 2014

(30) Foreign Application Priority Data

Dec. 27, 2012 (JP) ..... 2012-284906

(51) Int. Cl.
*G03G 15/00* (2006.01)
*G03G 15/08* (2006.01)

(52) U.S. Cl.
CPC ..... *G03G 15/553* (2013.01); *G03G 15/0863* (2013.01); *G03G 15/556* (2013.01)

(58) Field of Classification Search
CPC G03G 21/1875; G03G 21/1889; G03G 21/18
See application file for complete search history.

(56) References Cited

U.S. PATENT DOCUMENTS

| | | | | |
|---|---|---|---|---|
| 5,572,292 | A * | 11/1996 | Chatani et al. | 399/25 |
| 7,792,439 | B2 * | 9/2010 | Kikuchi | 399/24 |
| 2003/0103773 | A1 * | 6/2003 | Takeda | 399/12 |
| 2006/0051106 | A1 * | 3/2006 | Takahashi et al. | 399/12 |

FOREIGN PATENT DOCUMENTS

| | | | |
|---|---|---|---|
| JP | 2005-202147 | A | 7/2005 |
| JP | 2009-169003 | A | 7/2009 |
| JP | 2010-002555 | A | 1/2010 |
| JP | 2010-244049 | A | 10/2010 |

* cited by examiner

*Primary Examiner* — Clayton E Laballe
*Assistant Examiner* — Ruifeng Pu
(74) *Attorney, Agent, or Firm* — Marvin A. Motsenbocker; Mots Law, PLLC

(57) ABSTRACT

An image formation apparatus includes an image formation apparatus body, and a replacement member detachably provided in the image formation apparatus body and configured to be used for image formation. The replacement member includes a first storage to store a life determination value used in life determination of the replacement member. The image formation apparatus body includes a connection section configured to be connected to the first storage of the replacement member, and a controller configured to operate in: a first processing mode of accessing the first storage of the replacement member to acquire the life determination value and managing the life of the replacement member based on the acquired life determination value; and a second processing mode of managing the life of the replacement member such that the quality of image formation using the replacement member is not lower than that obtained through operation in the first processing mode.

6 Claims, 9 Drawing Sheets

"YES" IS SELECTED

*: DEFAULT

IMAGE FORMATION APPARATUS

CROSS REFERENCE TO RELATED APPLICATIONS

This application claims priority based on 35 USC 119 from prior Japanese Patent Application No. 2012-284906 filed on Dec. 27, 2012, entitled "IMAGE FORMATION APPARATUS", the entire contents of which are incorporated herein by reference.

BACKGROUND OF THE INVENTION

1. Field of the Invention

The disclosure relates to an image formation apparatus and is applicable to an electrophotographic printer, for example.

2. Description of Related Art

In a conventional image formation apparatus such as a printer, replaceable members, including drum units and toner cartridges, (hereinafter, also referred to as replacement members) are detachably provided. Like the technique described in Patent Literature 1 (Japanese Patent Laid-open Publication No. 2005-202147), some conventional replacement members mounted on printers are provided with memory tags storing specific information including life-span values, intended uses, and the like. The conventional printers process the information of memory tags attached to replacement members for identification of the individual replacement members, management of the lives thereof, and the like. The life span set in the memory tag of a replacement member, in particular, is set to a predetermined value at the design phase so as to satisfy the quality of prints by the printer. The printer compares the life span of the replacement member with the used amount to manage the life of the replacement member.

In recent years, managed printing services (MPS) are widespread as a service to provide optimized print environments in offices of companies and the like (for example, a service to guarantee print cost and/or quality). Conventional MPSs include services (contracts) to charge based on the number of prints instead of directly charging based on toner cartridges, for example. Moreover, some conventional MPS customers place more emphasis on the print cost than on the print quality (more prints at the same cost). Accordingly, the life spans required for the replacement members such as drum units depend on MPS customers. Accordingly, conventional printers and replacement members require management necessary to implement the MPS as described above.

SUMMARY OF THE INVENTION

Meanwhile, the balance between the print quality and cost that customers demand for printers depends on objects to be printed in some cases. For example, there are various types of users including users who place more emphasis on the print quality than on the number of prints, users who absolutely place emphasis on the print quality, and the like. Moreover, in some cases, the print environment needs to be changed so as to include a different balance. However, it is difficult for the conventional printers and replacement members to flexibly meet various requests from users as described above.

Accordingly, there is a demand for an image formation apparatus capable of flexibly managing replacement members concerning the quality or cost of image formation.

A first aspect of the invention is an image formation apparatus that includes: an image formation apparatus body; and a replacement member detachably provided in the image formation apparatus body and configured to be used for image formation. The replacement member includes a first storage configured to store a life determination value used in life determination of the replacement member. The image formation apparatus body includes: a connection section configured to be connected to the first storage of the replacement member; and a controller configured to operate in a first processing mode and in a second processing mode. The first processing mode functions to access the first storage of the replacement member to acquire the life determination value and to manage the life of the replacement member based on the acquired life determination value. The second processing mode functions to manage the life of the replacement member so that the quality of image formation using the replacement member is not lower than that obtained through operation in the first processing mode.

According to this aspect, it is possible to flexibly manage replacement members concerning the quality and cost of image formation.

DETAILED DESCRIPTION OF EMBODIMENTS

Figure 1:
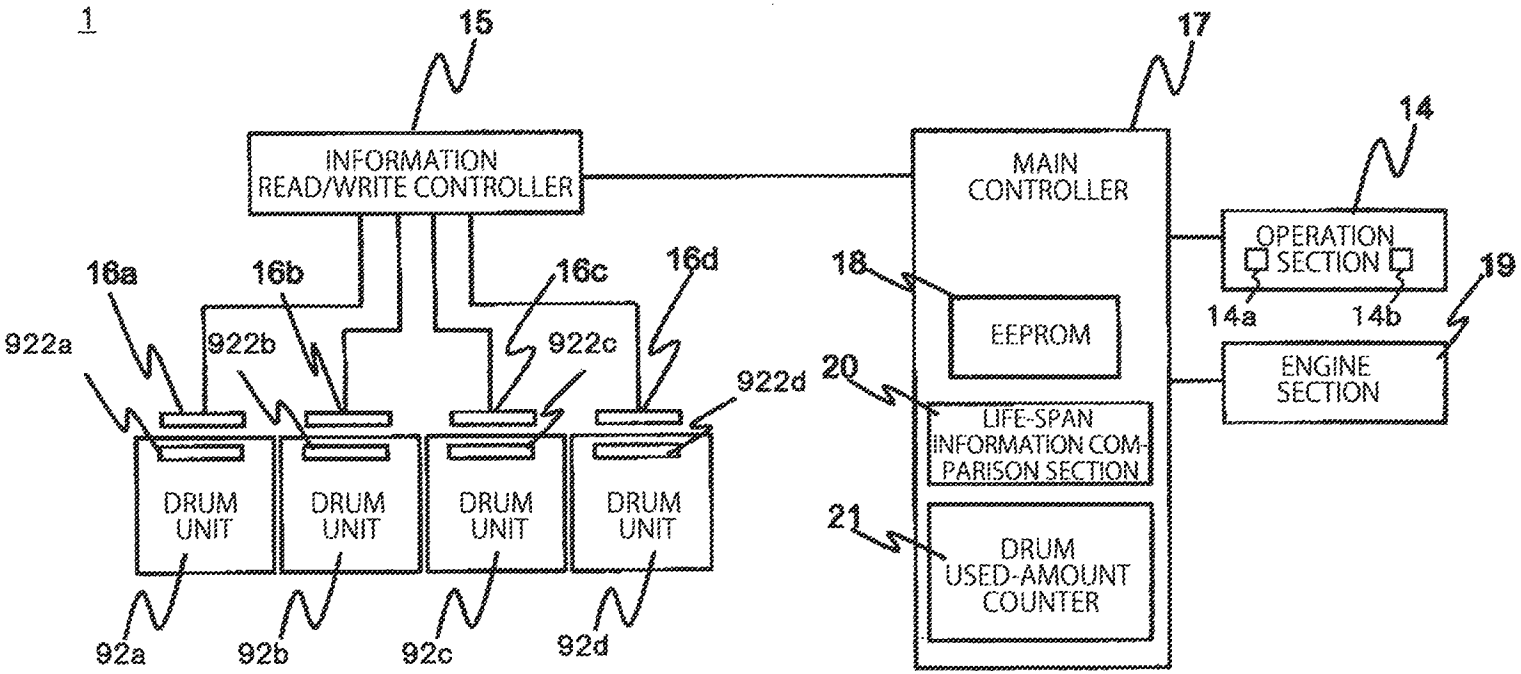
FIG. 1 is a block diagram illustrating a functional configuration of a control system of an image formation apparatus according to a first embodiment.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

(A) First Embodiment

Hereinafter, a description is given of a first embodiment of an image formation apparatus according to the invention in detail with reference to the drawings. In an example described in the first embodiment, the image formation apparatus of the invention is applied to a color printer.

(A-1) Configuration of First Embodiment

Figure 2:
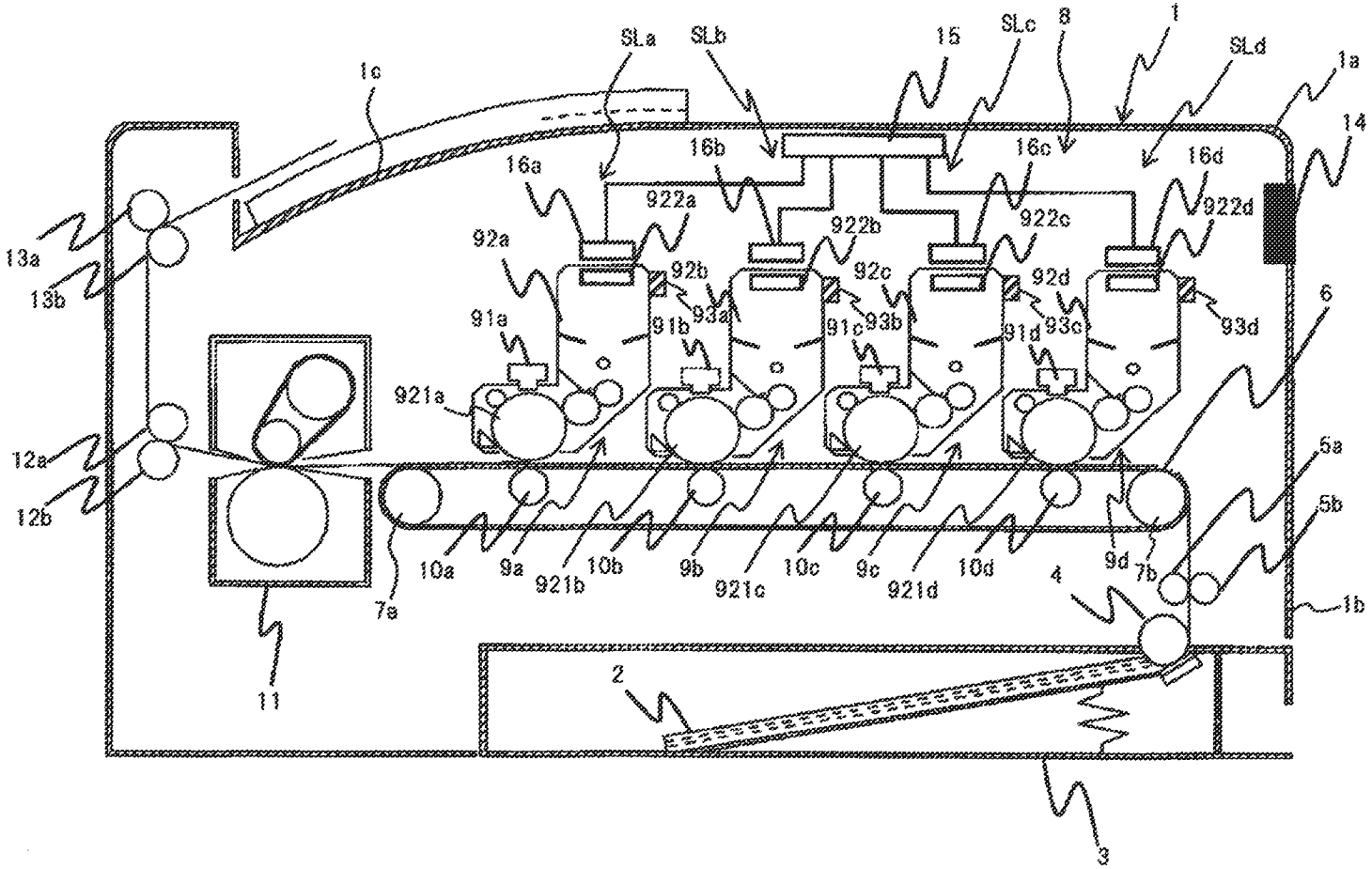
FIG. 2 is a schematic side cross-sectional view of the image formation apparatus according to the first embodiment.

FIG. 2 is a schematic side cross-sectional view of a color printer 1 of the first embodiment.

FIG. 1 is a block diagram illustrating a functional configuration of a control system of color printer 1 of the first embodiment.

Color printer 1 is an image formation apparatus configured to print (form) an image on recording media 2.

Color printer 1 includes: body 1*a* as an image formation apparatus body; and top cover 1*b* which is openable at an opening in the upper surface of body 1*a*.

Recording medium storage 3 is configured to store recording media 2 that are stacked on one another.

Paper feed roller 4 is configured to feed recording media 2 from recording medium storage 3 one by one.

Registration rollers 5*a* and 5*b* are conveyance rollers configured to convey to image formation section 8, recording media 2 fed from recording medium storage 3 by paper feed roller 4.

Conveyance belt 6 is configured to convey fed recording media 2 to the downstream side in the medium conveyance direction under the image formation section 8. Conveyance belt 6 is driven by conveyance belt driving rollers 7*a* and 7*b*.

Image formation section 8 is provided over conveyance belt 6. Image formation section 8 is configured to develop a toner image and transfer the developed toner image to each recording medium 2 on conveyance belt 6.

Image formation section 8 includes image formation units 9 corresponding to respective colors of toner materials. Image formation units 9 are arranged along the medium conveyance direction above conveyance belt 6. In the first embodiment, image formation section 8 includes four image formation units 9 (9*a* to 9*d*).

Image formation section 8 includes housing slots SL (SLa, SLb, SLc, and SLd) configured to accommodate four image formation units 9 (9*a* to 9*d*). In FIG. 2, image formation units 9 accommodated in housing slots Sla, SLb, SLc, and SLd are illustrated as image formation units 9*a*, 9*b*, 9*c*, and 9*d*, respectively.

Image formation units 9 (9*a* to 9*d*) include LED heads 91 (91*a* to 91*d*), drum units 92 (92*a* to 92*d*), and toner cartridges 93 (93*a* to 93*d*), respectively. Drum units 92 (92*a* to 92*d*) include photosensitive drums 921 (921*a* to 921*d*) and memory tags 922 (922*a* to 922*d*), respectively.

Toner cartridges 93 as a developer storage store toner materials of colors corresponding to image formation units 9, and the toner materials of toner cartridges 93 are supplied to respective drum units 92 (photosensitive drums 921). Each toner cartridge 93 is detachably provided for the corresponding one of housing slots SL (image formation units 8). In the first embodiment, toner cartridges 93 of C, M, Y, and K (cyan, magenta, yellow, and black) are provided in housing slots SLa, SLb, SLc, and SLd, respectively.

LED heads 91 as an exposure section are configured to project light onto photosensitive drums 921 of drum units 92 as the development unit based on control signals from main controller 17 to form an electrostatic latent image on the surface of each photosensitive drum 921. Each LED head 91 is supported by openable top cover 1*b* with a not-shown holder which can be moved. When top cover 1*b* is closed (the state shown in FIG. 2), LED heads 91 come close to the surfaces of respective photosensitive drums 921 of housing slots SL to allow exposure.

Drum units 92 as the development unit are configured to use photosensitive drums 921 for development of toner images. Specifically, in each drum unit 92, the surface (the photosensitive layer surface) of photosensitive drum 921 is charged and is irradiated with light from a corresponding LED head 91. This forms an electrostatic latent image on the surface of drum unit 92. In drum unit 92, a toner material of toner cartridge 93 is supplied to the surface of photosensitive drum 921 with the electrostatic latent image formed thereon for development of a toner image on the surface of photosensitive drum 921. Each drum unit 92 is detachably provided in the corresponding housing slot SL.

Each memory tag 922 (922*a*, 922*b*, 922*c*, and 922*d*) includes a substrate with a tag chip (IC chip) mounted thereon. The tag chip incorporates a non-volatile memory as a first storage. Memory tag 922 stores data concerning corresponding drum unit 92. The configuration of data stored in each memory tag 922 and the configuration to read and write (change) the data of memory tag 922 are described later.

Transfer rollers 10 (10*a* to 10*d*) are rollers opposed to respective photosensitive drums 921 (921*a* to 921*d*) with conveyance belt 6 interposed therebetween. Each transfer roller 10 is configured to transfer the toner image formed on opposed photosensitive drum 921 onto recording medium 2 fed on conveyance belt 6. High voltage is applied to photosensitive drum 921 and transfer rollers 10 through a not-shown high-voltage power supply to allow electrostatic electrophotographic processes including charge, development, and transfer.

Fixation section 11 is configured to fix the toner image transferred to recording medium 2 by means of heat, pressure, or the like.

Discharge rollers 12*a*, 12*b*, 13*a*, and 13*b* are rollers configured to deliver and place recording media 2 with the toner image fixed thereon to an output stacker (the upper surface of top cover 1*b*) 1*c*.

Operation section 14 as an operation reception unit is composed of a printed substrate including liquid crystal display panel 14*a*, switch section 14*b*, and the like and plays a function of displaying the state of color printer 1 and a function of receiving input operation by a user (a user interface function). Operation section 14 is connected to the main controller 17 via cable.

Liquid crystal display panel 14*a* is capable of displaying 24 characters by 2 lines, for example. As described later, the drum life-span value and the like to be set in each memory tag 922 can be selected and set through operation section 14.

Next, a description is given of the configuration to perform data processing for memory tags 922 (922*a* to 922*d*) of drum units 92 (92*a* to 92*d*) (the configuration to manage the life of each drum unit 92) in color printer 1 with reference to FIGS. 1 and 2.

As illustrated in FIGS. 1 and 2, in addition to the aforementioned constituent elements, color printer 1 includes main controller 17, engine section 19, information read/write controller 15, and contact sections 16 (16*a* to 16*d*) corresponding to respective drum units 92 (92*a* to 92*d*) as the constituent elements playing functions of the control system. From a functional perspective, main controller 17 includes EEPROM 18 as a non-volatile memory, life-span information comparison section 20, and drum used-amount counter 21.

Main controller 17 is a central section that controls each operation of color printer 1. Main controller 17 includes a computer executing a program with a processor and the like. In main controller 17, the computer executes various types of processes according to the program that controls the entire apparatus. Main controller 17 is connected to operation section 14, information read/write controller 15, and engine section 19 through input/output ports.

Engine section 19 is configured to control an actuator (not shown) conveying/discharging recording media 2, sensors (not shown) detecting various conditions, the high voltage power supply, the temperature of fixation section 11, and the like.

Information read/write controller 15 as a connection section is configured to access data of memory tags 922 (922*a* to 922*d*) of drum units 92 (92*a* to 92*d*) through contact sections 16 (16*a* to 16*d*), respectively. Information read/write controller 15 communicates with each memory tag 922 according to the control by main controller 17 to execute read and write (including addition, change, and deletion) of recording data.

Contact sections 16 (16*a* to 16*d*) are contacts provided at such a place to be electrically connected to (come into contact with) memory tags 922 (922*a* to 922*d*) of drum units 92 (92*a* to 92*d*) mounted on body 1*a*.

In the description of the first embodiment, memory tags 922 are configured to come into contact with contact sections 16 to be electrically connected to main controller 17 for communication. However, memory tags 922 may communicate with main controller 17 in a non-contact manner via wireless communication such as RFID (radio frequency identification).

EEPROM 18 as a second storage includes storage elements such as non-volatile memories and the like and functions as a storage unit configured to hold various information necessary to control color printer 1 and the like.

Life-span information comparison section 20 is configured to compare the life-span information read from each memory tag 922 with life-span information set in EEPROM 18 (described later in detail).

Drum used-amount counter 21 is configured to count the used amount of each drum unit 92 (92*a* to 92*d*). In the description of the first embodiment, the number of counts concerning each drum unit 92 is incremented (plus 1) at each time that drum unit 92 prints one A4-size sheet of printing paper (one side print). Drum used-amount counter 21 continuously counts the number of drum revolutions (a value corresponding to the number of predetermined sheets that can be printed) and reflects the counted number on corresponding memory tag 922 and EEPROM 18.

Figure 3A:
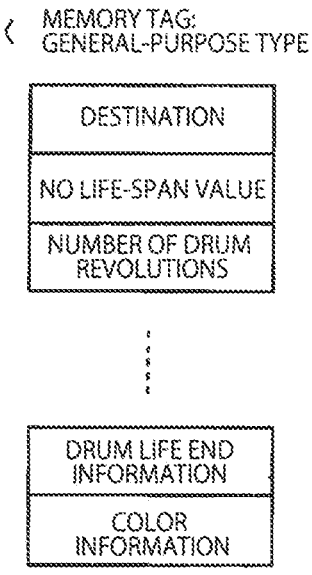
FIGS. 3A to 3C are block diagrams illustrating data structures of memory tags of drum units and an EEPROM mounted on the image formation apparatus according to the first embodiment.
Figure 3B:
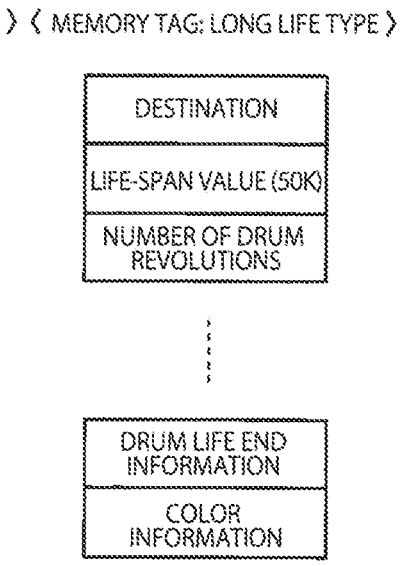
Figure 3C:
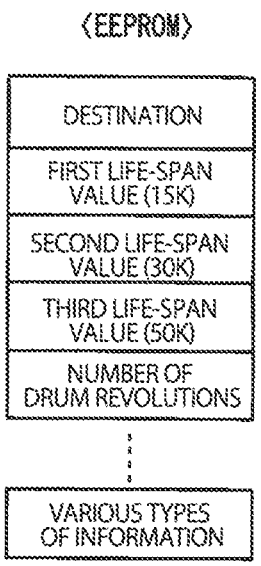

Next, a description is given of examples of data structures of memory tags 922 and EEPROM 18 with reference to FIGS. 3A to 3C.

FIGS. 3A and 3B are explanatory views illustrating examples of the structures of data stored in memory tags 922. FIG. 3C is an explanatory view illustrating an example of the structure of data of EEPROM 18. In FIGS. 3A to 3C, the values in brackets following respective item names of stored data are shown as setting values (parameter values) corresponding to the respective item names.

As illustrated in FIGS. 3A and 3B, each memory tag 922 stores data of items including at least "Destination", "Life-span value", "Number of drum revolutions", "Drum life end information", and "Color information".

The item "Destination" is information indentifying the region of the destination such as Domestic and Europe. The data format of "Destination" is not limited and may be defined in such a manner that "Domestic" and "Europe" are indicated by 0 and 1, respectively.

The item "Number of drum revolutions" indicates the used amount of each drum unit 92 with the memory tag 922 attached thereto (the cumulative number of counts by the drum used-amount counter 21).

The item "Life-span value" indicates threshold information (Life determination value) used to determine the end of life of each drum unit 92. In the first embodiment, the life-span value concerning each drum unit 92 refers to the upper limit of the number of drum revolutions (the drum used amount) concerning the same drum unit 92. In other words, in color printer 1, each drum unit 92 can be used until the number of counts by drum used-amount counter 21 reaches the value set in the item "Life-span value" of memory tag 922. It is assumed that, when the number of drum revolutions (the drum usage) of drum unit 92 exceeds the life-span value, degradation of the print quality (for example, so-called fogging) or damage of color printer 1 can occur. Accordingly, when the drum used amount (the number of drum revolutions) exceeds the life-span value, color printer 1 is controlled so as to be disabled. The life-span value is a value adequately evaluated and determined at the design phase of color printer 1.

In the first embodiment, memory tags 922 are of two types depending on the intended use of drum units 92, including general-purpose type and MPS type. As illustrated in FIG. 3A, each memory tag 922 to be mounted on the general-purpose type of drum units 92 does not include a life-span value. Each memory tag 922 to be mounted on an MPS type of drum unit 92 includes a life-span value set to a certain numeral value as illustrated in FIG. 3B. Memory tags 922 mounted on the MPS type of drum units 92 illustrated in FIG. 3B are of long life type with the life-span value set to 50000. The long life type places more emphasis on the length of life than the image quality.

As described above, it is assumed that drum units 92 (memory tags 922) with the life-span value properly set for a print environment to be guaranteed are provided for MPS customers according to the contract. In other words, in the first embodiment, when the user of color printer 1 is a MPS customer, all of drum units 92 (memory tags 922) mounted on color printer 1 are of a MPS type. Moreover, in the first embodiment, it is assumed that when the user of color printer 1 is not a MPS customer, all of drum units 92 (memory tags 922) mounted on color printer 1 are of a general-purpose type.

The item "Drum life end information" is flag information indicating whether the number of drum revolutions (drum used amount; actual use) of each drum unit 92 exceeds the life-span value (the threshold value). In the first embodiment, the initial value of the drum life end information is set to 0, and the drum life end information is set to 1 when the number of drum revolutions of drum unit 92 exceeds the life-span value (threshold value).

The item "Color information" is information to identify toner color (the type of toner cartridges 93) of the toner material used in each drum unit 92 and is set to any one of C, M, Y, and K.

EEPROM 18 stores data of the items including the destination, the life-span value, the number of drum revolutions, and various information as illustrated in FIG. 3C.

In the item "Destination" in EEPROM 18, data of the destination concerning the body of color printer 1 is set similar to that of memory tags 922 described above.

In the item "Number of drum revolutions" in EEPROM 18, the number of drum revolutions is set concerning each drum unit 92 (memory tag 922).

When main controller 17 detects that anyone of drum units 92 accommodated in housing slots SL is new (the number of drum revolutions of any drum unit 92 is 0 in memory tag 922), main controller 17 clears (to 0) the number of drum revolutions corresponding to new drum unit 92 (housing slot SL) in EEPROM 18. When detecting that any one of drum units 92 (memory tags 922) has a number of drum revolutions different from the number of drum revolutions set in EEPROM 18, main controller 17 may synchronize the number of drum revolutions corresponding to drum unit 92 (housing slot SL)

of interest in EEPROM 18 with the number of drum revolutions set in the same drum unit 92 (memory tag 922).

EEPROM 18 includes plural life-span values set as illustrated in FIG. 3C. The life-span values set in EEPROM 18 are master values that main controller 17 applies as the life-span values of drum units 92 (memory tags 922) when needed. As illustrated in FIG. 3C, EEPROM 18 of the first embodiment includes a first life-span value (15000), a second life-span value (30000), and a third life-span value (50000). The number of life-span values set in EEPROM 18 and the value of each life-span value are not limited (which may be configured to be changeable by a user's operation).

In the first embodiment, the second life-span value (30000) is a life-span value which guarantees standard image quality (hereinafter, also referred to as a referential life-span value). The first life-span value (15000) is a life-span value which guarantees high image quality (the quality of image formation higher than that by the second life-span value). The third life-span value (50000) is a life-span value which guarantees a life long enough not to damage the body of color printer 1 but provides low image quality (lower quality of image formation than that by the second life-span value).

The various information set in EEPROM 18, which is not described in detail, is various information used to control the operation of color printer 1.

(A-2) Operation of First Embodiment

Next, a description is given of the operation of color printer 1 of the first embodiment having the above described configuration.

(A-2-1) Summary of Operation of Color Printer 1

Figure 5:
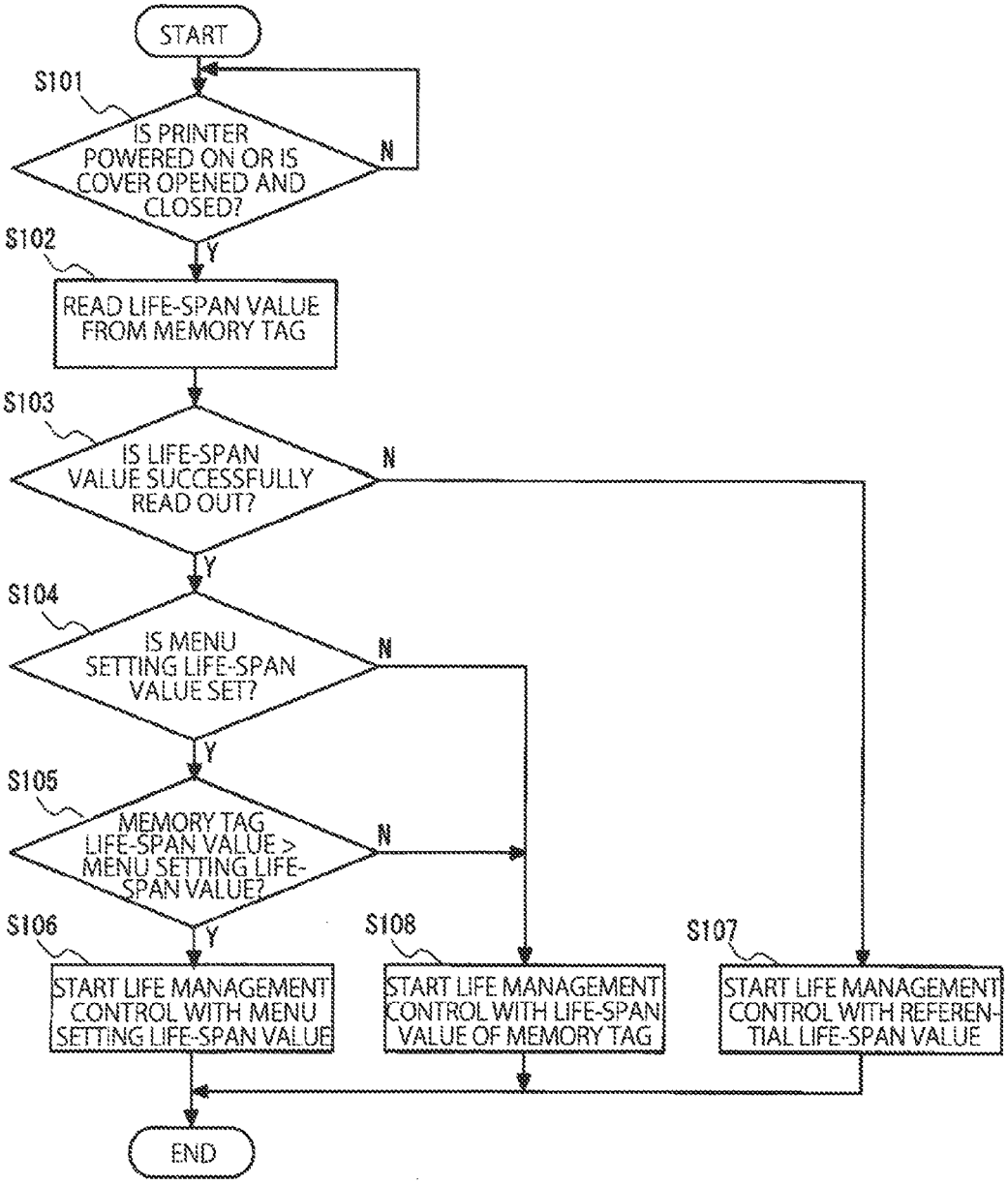
FIG. 5 is a flowchart illustrating an operation of the image formation apparatus according to the first embodiment.

FIG. 5 is an explanatory view illustrating the operation of color printer 1 of the first embodiment.

For convenience of explanation, it is assumed that all of drum units 92 (memory tags 922) mounted on color printer 1 are of any one of the general-purpose type and MPS type in the following description. Moreover, for convenience of explanation, when drum units 92 (memory tags 922) mounted on color printer 1 are of the MPS type, the life-span values set in all drum units 92 (memory tags 922) are the same in the following description.

When main controller 17 of color printer 1 is started (powered on), or when top cover 1*b* is closed from the open state while color printer 1 is on (S101), main controller 17 proceeds to the operation of the next step S102.

Main controller 17 then tries to read the life-span value from memory tag 922 of each housing slot SL through information read/write controller 15 (S102).

In step S102, main controller 17 may be configured to perform the following operation: main controller 17 compares the destination information of memory tag 922 of drum unit 92 accommodated in each housing slot SL with that stored in EEPROM 18. When detecting that the destination information of any one of memory tags 922 is different from that in EEPROM 18, main controller 17 displays this fact on display section 14 to inform the user and then stops the subsequent operation.

Main controller 17 then confirms whether main controller 17 has successfully read the life-span value from each memory tag 922 (S103). When there is no life-span value set in each memory tag 922 (in the case of the general-purpose type of drum units 92), main controller 17 fails to read the life-span values from memory tags 922. When main controller 17 confirms in step S103 that main controller 17 has successfully read the life-span value from each memory tag 922, main controller 17 proceeds to step S104, described later; otherwise, main controller 17 proceeds to step S107, also described later.

When it is confirmed in step S103 that the life-span values are successfully read out from memory tags 922, main controller 17 performs a process of receiving an user's input whether to change the life-span value of drum unit 92 corresponding to each memory tag 922 (whether to perform high quality printing) using operation section 14 (S104).

Figure 4A:
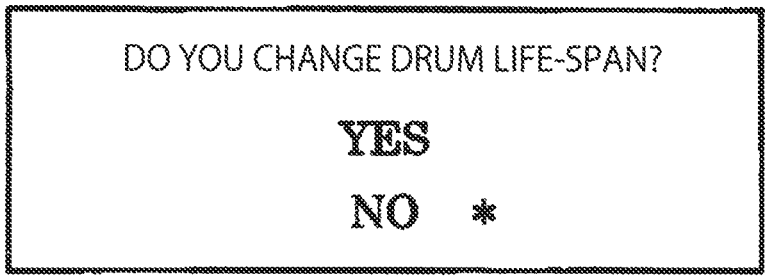
FIGS. 4A and 4B are explanatory views illustrating configuration examples of an operation screen displayed on an operation section of the image formation apparatus according to the first embodiment.
Figure 4A:
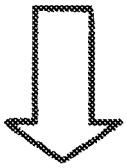
Figure 4B:
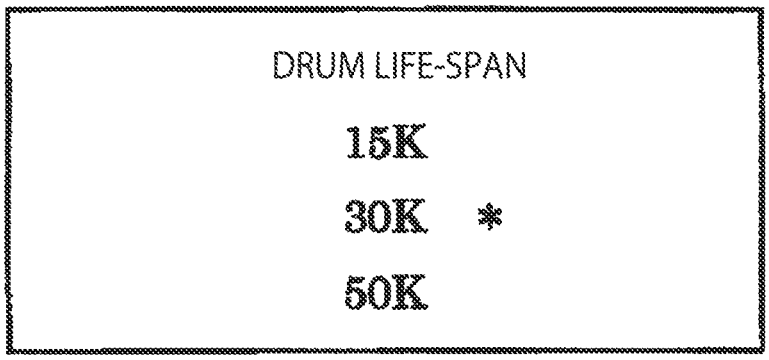

The configuration of a screen of operation section 14 through which the life-span value is changed by the user is not limited, but may be a configuration illustrated in FIGS. 4A and 4B, for example.

For example, main controller 17 displays on operation section 14 (liquid crystal display panel 14*a*) a screen that causes a user to select whether to change the life-span values like FIG. 4A (hereinafter, referred to as a life-span value change selection screen). In the screen configuration illustrated in FIG. 4A, selection keys of "YES" and "NO" are displayed together with the message of "Will you change drum life-span value?" and any one of the selection keys is determined by the user's operation (for example, operation of switch section 14*b*).

In the life-span value change selection screen illustrated in FIG. 4A, the selection key of NO is a default.

When the selection key of NO is selected in the life-span value change selection screen, main controller 17 determines not to change the life-span value and proceeds to the process of step S108 described later.

On the other hand, when the selection key of YES is selected on the life-span value change selection screen, main controller 17 displays, on operation section 14 (liquid crystal display panel 14*a*), a screen which causes the user to select a life-span value based on menu settings (user settings; referred to as menu setting life-span values), as illustrated in FIG. 4B (hereinafter, referred to as a life-span value selection screen).

In the screen configuration illustrated in FIG. 4B, three selection keys are displayed, including "15k" corresponding to the first life-span value of EEPROM 18, "30k" corresponding to the second life-span value thereof, and "50k" corresponding to the third life-span value thereof, together with a message "Drum Life-span." Any one of the three selection keys is determined by the user's operation (for example, the operation of switch section 14*b*). In the life-span value selection screen illustrated in FIG. 4B, the selection key of 30k corresponding to the second life-span value (referential life-span value) is a default. The life-span values displayed on the life-span value selection screen are shown as a list of life-span values set in EEPROM 18.

When any one of the life-span values is selected on the life-span value selection screen, main controller 17 determines that the life-span value is changed and proceeds to the process of step S105 described later.

When the user changes the life-span value in step S104 described above, life-span information comparison section 20 compares the menu setting life-span value with the life-span value of each memory tag 922 (the life-span value read in step S102 described above) in main controller 17 (S105). When the life-span value of each memory tag 922 is larger than the menu setting life-span value, main controller 17 then proceeds to step S106 described later; otherwise, main controller 17 proceeds to step S108 described later. In the description of the first embodiment, for convenience of explanation, all of the life-span values of memory tags 922 are the same as described above.

When main controller 17 determines in step S105 that the life-span value of each memory tag 922 is not larger than the menu setting life-span value, main controller 17 may return to step S104 above and again receive another user's input.

When main controller 17 determines in step S105 that the life-span value of each memory tag 922 is larger than the menu setting life-span value, main controller 17 starts life management control with the life-span value of drum unit 92 concerning the memory tag 922 of interest, set to the menu setting life-span value (a life-span value set in step S104 described above) (S106).

On the other hand, when main controller 17 determines in step S103 described above that main controller 17 has failed to read the life-span value from each memory tag 922, main controller 17 starts life management control with the life-span value of drum unit 92, concerning the memory tag 922 of interest, set to the referential life-span value in EEPROM 18 (the second life-span value (30000)) (S107).

On the other hand, when main controller 17 determines in step S105 described above that the life-span value selected by the user is not larger than the life-span value of each memory tag 922, or when the user has not changed the life-span value in step S104 described above, main controller 17 starts the life management control with the life-span values of drum units 92 concerning memory tags 922 directly set to the life-span values stored in respective memory tags 922 (S108).

Next, a description is given of a specific operation example of color printer 1 according to the flowchart of FIG. 5 described above.

For example, even an MPS customer who is provided with drum unit 92 of a long life type, that places emphasis on print cost (for example, the life-span value is 5000), sometimes demands high-quality print depending on the purposes thereof even at a high cost (for example, in the case of prints requiring high quality, for example, documents for customers). In such a case, the MPS customer selects the first life-span value (15000) or second life-span value (30000) of the menu setting life-span values on the life-span value selection screen at step S105 described above. This can guarantee printing with higher quality (at higher cost). In this case, main controller 17 compares the menu setting life-span value (15000 or 30000) selected by the user with the life-span value (50000) of memory tag 922 in step S105 described above and applies the menu setting life-span value (15000 or 30000) which is smaller.

In the following, a processing mode in which main controller 17 directly uses the life-span values of memory tags 92 to perform the life management control of MPS-type drum units 92 (memory tags 922) as shown in step S108 is referred to as a first processing mode. Moreover, a processing mode in which main controller 17 performs the life management control of MPS-type drum units 92 (memory tags 922) so that the printing is performed at a higher quality than the first processing mode is referred to as a second processing mode like step S106. The second processing mode needs to provide higher printing quality than that in the first processing mode. In other words, in the second processing mode, the method of determining the life-span value that main controller 17 applies to the life management control of drum units 92 is not limited if the applied life-span value is smaller than the life-span value of memory tags 922. For example, main controller 17 may allow the user to select only whether to demand high quality printing in steps S104 and S105 described above. When the user demands high quality printing, main controller 17 operates in the second processing mode; otherwise, main controller 17 operates in the first processing mode. In such a case, main controller 17 may apply a value obtained by retracting a certain value from the life-span value of memory tag 922 or reducing the same by a certain proportion. Alternatively, main controller 17 may apply a predetermined life-span value.

(A-3) Effect of First Embodiment

According to the first embodiment, the following effects can be obtained.

In color printer 1, main controller 17 performs life management control of drum units 92 using proper life-span values according to the settings by the user. In the case where an MPS customer uses color printer 1, it is possible to provide a print environment out of the range of the MPS contract. For example, it may be an environment where the MPS customer places an emphasis on the print cost, in which case a printing can be performed that places an emphasis on the print quality without requiring a complicated management by the customer.

If dedicated drum units are prepared to provide a print environment out of the range of the MPS contract, the cost concerning the drum units is increased (for example, the management of drum units at production factories and the like becomes complicated). However, use of color printer 1 of the first embodiment eliminates the necessity for such dedicated drums.

Moreover, color printer 1 can employ not only MPS-type drum units, but also general-purpose type drum units (drum units with no life-span value set). Accordingly, color printer 1 can be used by any user, whether or not the user is a MPS customer.

(B) Second Embodiment

Hereinafter, a description is given of a second embodiment of the image formation apparatus according to the invention in detail with reference to the drawings. In the description of the second embodiment, the image formation apparatus of the invention is applied to a color printer.

(B-1) Configuration of Second Embodiment

Figure 6:
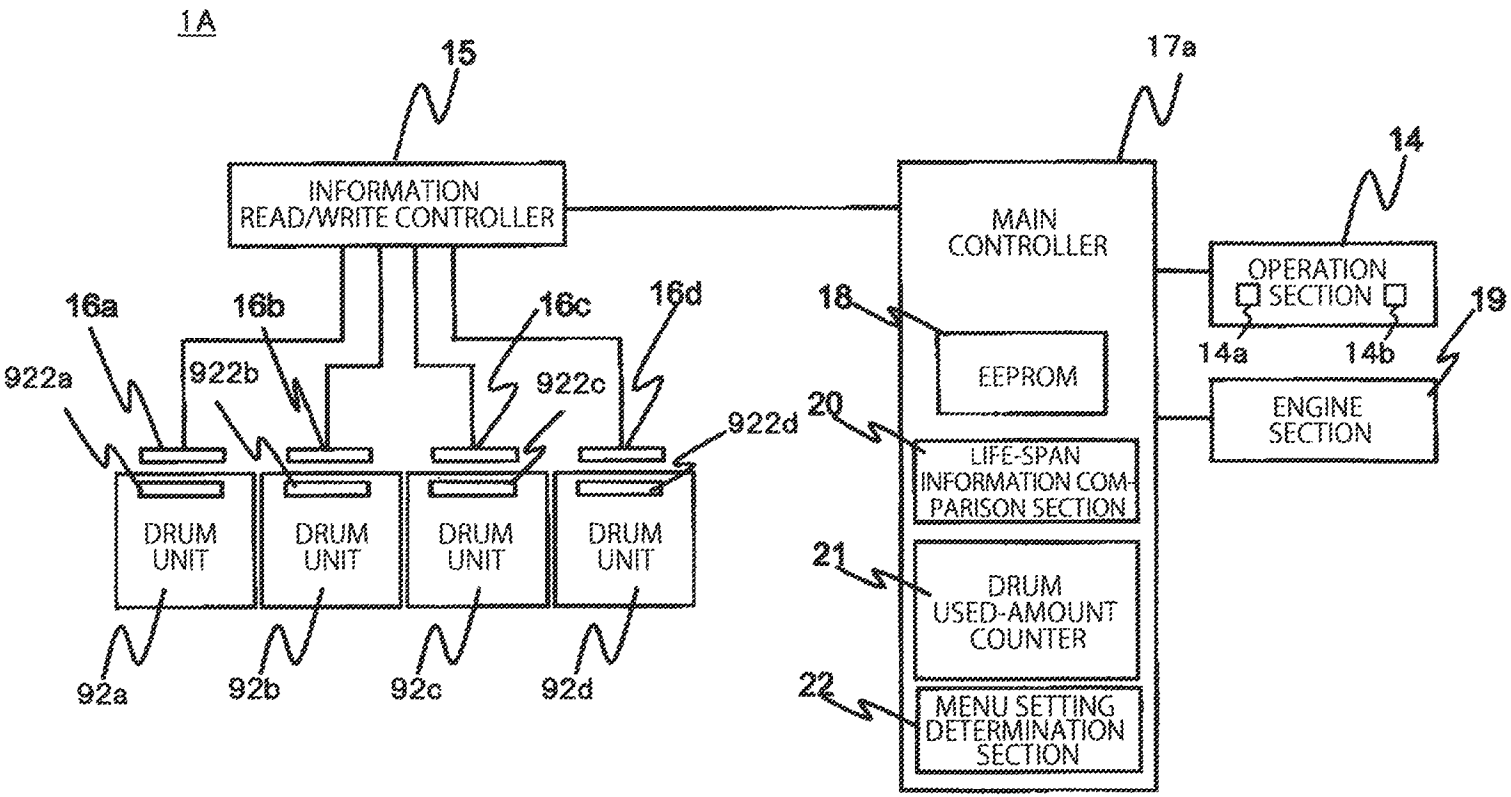
FIG. 6 is a block diagram illustrating a functional configuration of a control system of an image formation apparatus according to a second embodiment.

FIG. 6 is a block diagram illustrating a configuration of a control system of color printer 1A of the second embodiment. The hardware configuration (a schematic side cross-sectional view) of color printer 1A of the second embodiment is the same as that shown in FIG. 2 of the first embodiment. Hereinafter, a description is given of only the differences between the first and second embodiments.

In color printer 1A of the second embodiment, main controller 17 is replaced with main controller 17A. Main controller 17A is different from that of the first embodiment in that it further includes a menu setting determination section 22.

FIG. 7 is an explanatory view illustrating the data structures of memory tags 922 mounted on drum units 92 and EEPROM 18 in the second embodiment.

Figure 7A:
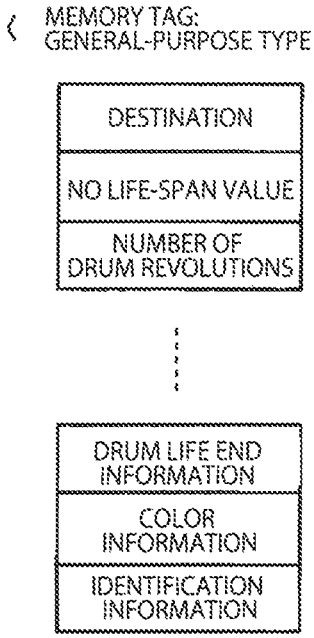
FIGS. 7A to 7C are block diagrams illustrating data structures of memory tags of drum units and an EEPROM mounted on the image formation apparatus according to the second embodiment.
Figure 7B:
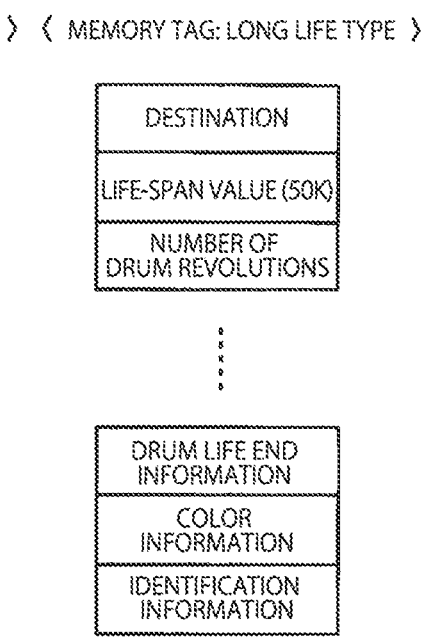
Figure 7C:
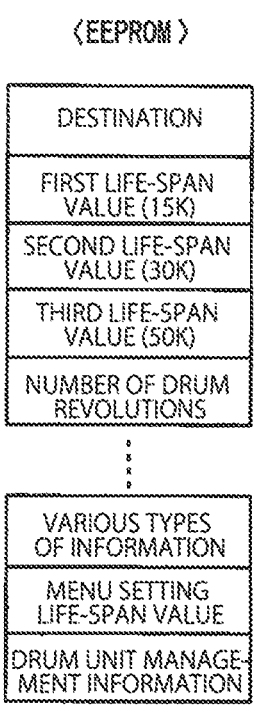

FIG. 7A illustrates the data structure of memory tags 922 mounted on the general-purpose type of drum units 92. FIG. 7B illustrates the data structure of memory tags 922 mounted on the MPS type of drum units 92. Moreover, FIG. 7C illustrates the data structure of EEPROM 18.

As illustrated in FIGS. 7A and 7B, memory tags 922 of the second embodiment differ from those of the first embodiment in that each includes identification information to identify individual drum units 92 (memory tags 922) regardless of the type thereof (MPS type or general-purpose type).

Menu setting determination section 22 is configured to determine whether the user performs a menu life-span setting in color printer 1 (whether the menu setting life-span value is set). For example, as illustrated in FIG. 7C, in the second embodiment, main controller 17A sets the menu setting life-span value in EEPROM 18 when the menu life-span setting is performed. In the second embodiment, the initial value (0, for example) of the menu setting life-span value set in EEPROM 18 means that menu life-span value setting is not performed.

In other words, menu setting determination section 22 determines whether menu life-span value setting is performed based on the menu setting life-span value set in EEPROM 18.

As illustrated in FIG. 7C, in the second embodiment, EEPROM 18 stores drum unit management information. The drum unit management information indicates identification information concerning drum unit 92 (memory tag 922) of each housing slot SL. Main controller 17A is configured to confirm whether drum unit 92 is replaced after the previous operation with reference to the drum unit management information at the time of the start processes. When color printer 1A normally finishes the start process and the like and then transits to a print enabled state, main controller 17A acquires the identification information from memory tag 922 of each housing slot SL and updates the drum unit management information of EEPROM 18.

(B-2) Operation of Second Embodiment

Next, a description is given of an operation of color printer 1A of the second embodiment including the aforementioned configuration.

(B-2-1) Summary of Operation of Color Printer 1A

Figure 8:
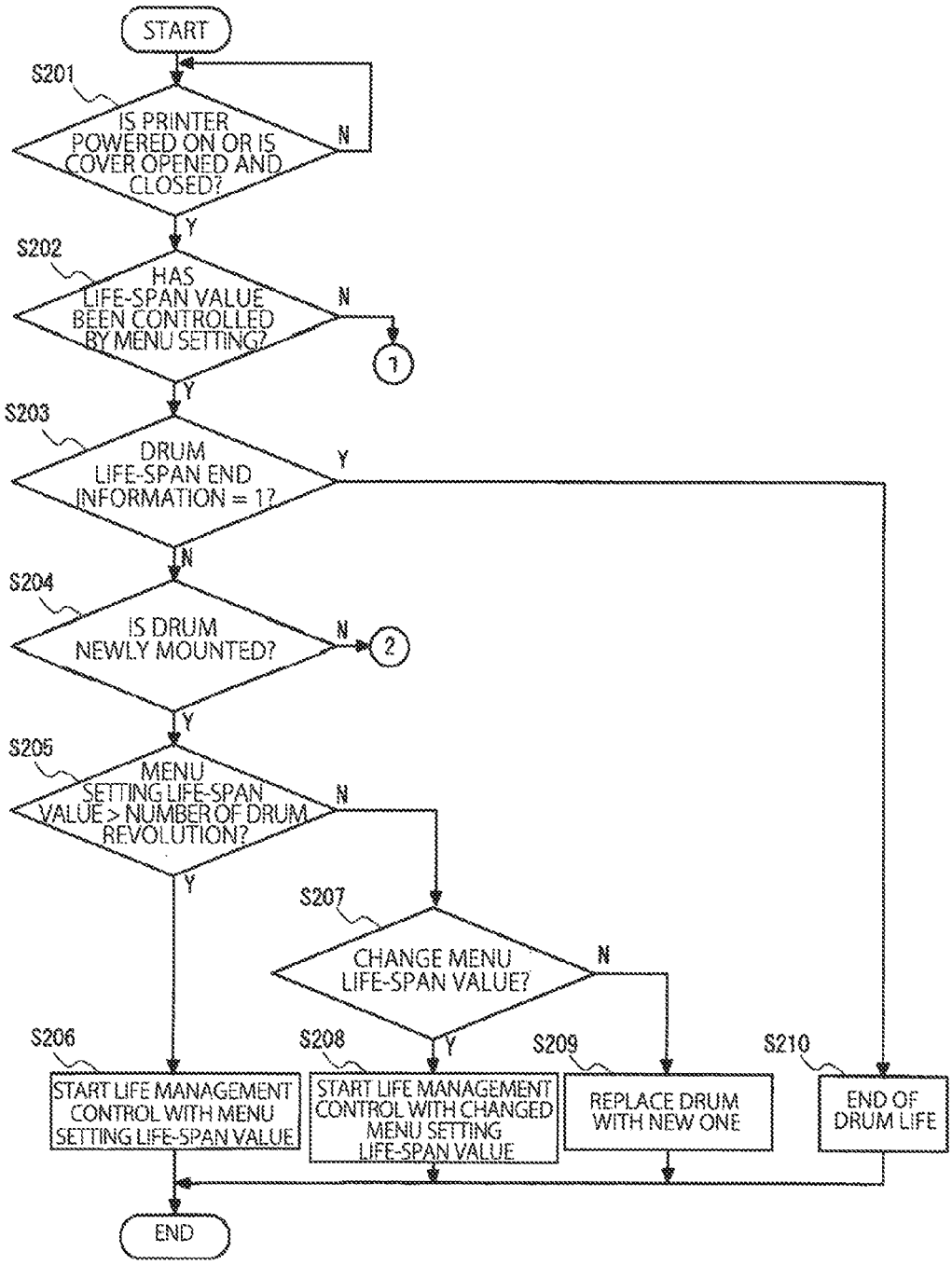
FIG. 8 is a flowchart (No. 1) illustrating an operation of the image formation apparatus according to the second embodiment.
Figure 9:
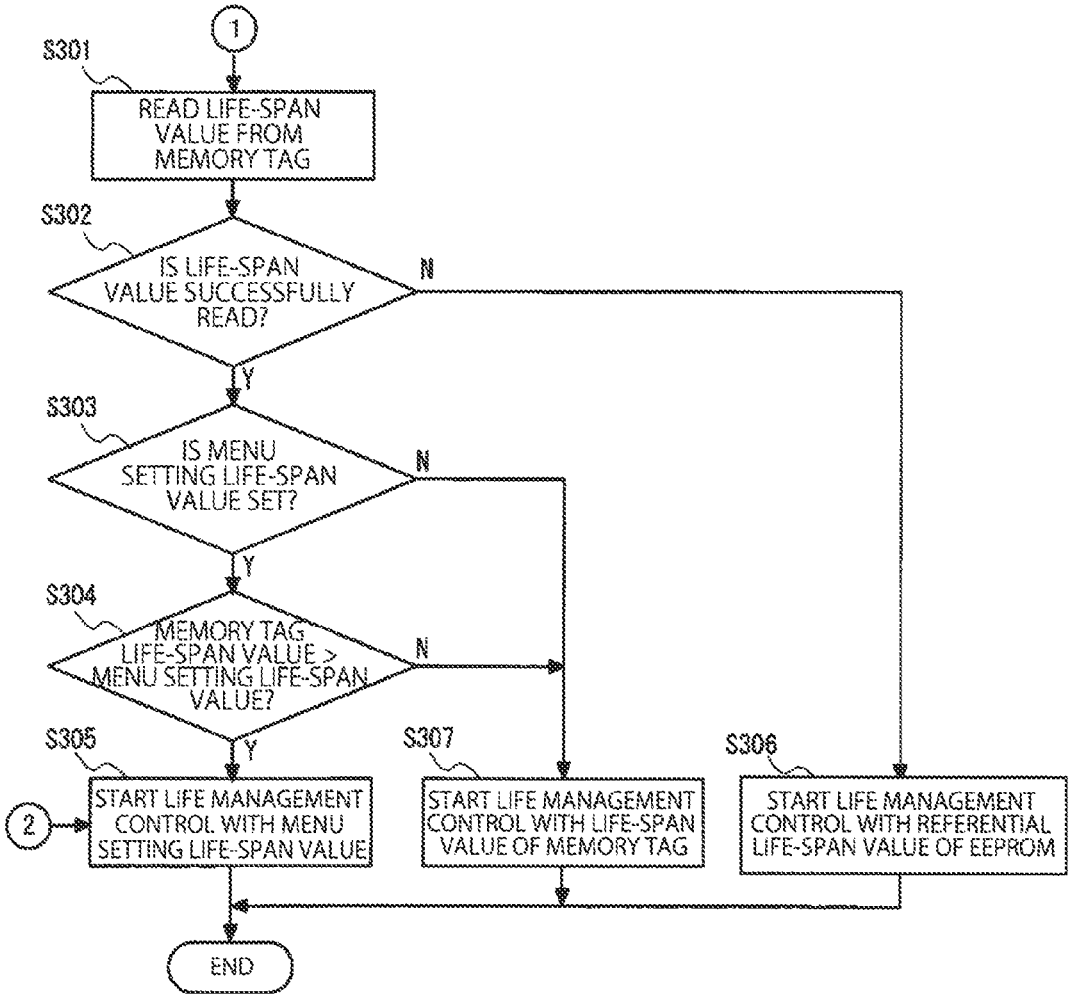
FIG. 9 is a flowchart (No. 2) illustrating the operation of the image formation apparatus according to the second embodiment.

FIGS. 8 and 9 are explanatory views illustrating the operation of color printer 1A of the second embodiment.

When main controller 17A of color printer 1A is started (powered on), or when top cover 1*b* is closed from the open state while color printer 1A is on (S201), main controller 17A proceeds to the operation of next step S202.

Main controller 17A (menu setting determination section 22) determines, based on the contents of EEPROM 18, whether a life management control has been performed with a menu setting life-span value in color printer 1A (S202).

When main controller 17A (menu setting determination section 22) determines that the life management control is not performed with the menu setting life-span value in color printer 1A, main controller 17A proceeds to step S203 later described; otherwise, main controller 17A proceeds to step S301 later described. The operations of steps S301 to S307 are substantially the same as those of the aforementioned steps S102 to S108, and the detailed description thereof is omitted. Steps S301 to S307 differ from those of the first embodiment in that main controller 17A registers the menu setting life-span value in EEPROM 18 at the life-span value menu setting (step S304 corresponding to step S105).

If main controller 17A determines in step S202, described above, that life management control has been performed with the menu setting life-span value, main controller 17A accesses each memory tag 922 through information read/write controller 15 and confirms the presence of memory tag 922 in which the drum life end information is 1 (S203).

When memory controller 17A detects memory tag 922 with the drum life end information being 1, main controller 17A proceeds to step S210 described later; otherwise, main controller 17A proceeds to step S204 described later.

When memory tag 922 with the drum life end information written as 1 is detected in step S203 described above, main controller 17A uses operation section 14 to perform an informing process that requires the user to change drum unit 92 (for example, a process of outputting a message such as "Replace the drum unit") and then stops the operation (S210).

On the other hand, when main controller 17A has not detected memory tag 922 with the drum life end information being 1 in step S203 described above, main controller 17A confirms whether each drum unit 92 is the drum unit 92 mounted after the previous operation (S204).

If main controller 17A detects a newly-mounted drum unit 92, main controller 17A proceeds to the process of step S205 described later; otherwise, main controller 17A proceeds to the process of step S305.

When main controller 17A detects a new drum unit 92, main controller 17A confirms whether the numbers of drum revolutions set in memory tags 922 of all newly-mounted drum units 92 are smaller than the menu setting life-span value of EEPROM 18 (S205). In other words, main controller 17A confirms the presence of drum unit 92 (memory tag 922) with the number of drum revolutions being not smaller than the menu setting life-span value.

When main controller 17A does not detect drum unit 92 (memory tag 922) including a number of drum revolutions larger than the menu setting life-span value in step S205 described above, main controller 17A starts the life management control directly using the menu setting life-span value of EEPROM 18 (S206).

On the other hand, when main controller 17A detects drum units 92 (memory tags 922) with a number of drum revolutions larger than the menu setting life-span value in step S205 described above, main controller 17A uses operation section 14 to perform a process of receiving an input from a user as to whether to change the life-span value of drum unit 92 corresponding to each memory tag 922 (S207).

The configuration of a screen of operation section 14 through which the change of the life-span value by the user is received, that is not limited, and may be a configuration illustrated in FIGS. 4A and 4B, for example. For example, similar to FIG. 4A, main controller 17A displays through operation section 14 (liquid crystal display panel 14*a*), a life-span value change selection screen that causes the user to select whether to change the life-span value. In the second embodiment, when the selection key of No is selected in the life-span value change selection screen, main controller 17A determines not to change the life-span value and then proceeds to the process of step S209 described later.

On the other hand, when the selection key of Yes is selected on the life-span value change selection screen, main controller 17A displays on operation section 14 (liquid crystal display panel 14*a*), as a life-span value selection screen that causes the user to select a menu setting life-span value in a similar manner to FIG. 4B.

When any one of the life-span values is selected in the life-span value selection screen, main controller 17A determines that the life-span value is changed and then proceeds to the process of step S208 described later.

When any one of the life-span values is selected on the life-span value selection screen in step S207 described above, main controller 17A sets the menu setting life-span value (the life-span value set in step S207 described above) as the menu setting life-span value of EEPROM 18, and then starts the life management control of drum units 92 (memory tag 922) using the menu setting life-span value (S208).

On the other hand, when the menu setting life-span value is not changed by the user in step S207 described above, main controller 17 uses operation section 14 to inform the user of requiring replacement of drum unit 92, and then stops the operation (S209).

Next, a description is given of a specific operation example of color printer 1A according to the flowcharts of FIGS. 8 and 9 described above.

For example, it is assumed that a MPS customer uses first color printer 1A-1 with the menu setting life-span value set to 15000 and a second color printer 1A-2 with the menu setting life-span value set to 30000.

In this case, by the processes of steps S204 to S209 described above, proper life management can be implemented even when drum units 92 (memory tags 922) are exchanged between first and second color printers 1A-1 and 1A-2.

Furthermore, even when the number of drum revolutions of drum unit 92 (memory tag 922) used in first color printer 1A-1 exceeds the menu setting life-span value, for example, same drum unit 92 can be mounted on second color printer 1A-2. This allows an effective use of drum units 92 (memory tags 922) while managing the print quality and cost.

Moreover, it is desirable that main controller 17A is configured to not change the drum life end information from 0 to 1 until the number of drum revolutions of memory tag 922 exceeds the life-span value of same memory tag 922, even when the number of drum revolutions of memory tag 922 exceeds the menu setting life-span value. This is a configuration that takes into account a consideration of the operation in the case where color printers individually include different menu setting life-span values. Specifically, the above configuration is necessary when drum unit 92 (memory tag 922), which is used in first color printer 1A-1 and includes a number of drum revolutions exceeding the menu setting life-span value, is continuously used in second color printer 1A-2.

(B-3) Effect of Second Embodiment

According to the second embodiment, it is possible to provide the following effects in addition to the effects of the first embodiment.

In color printer 1A of the second embodiment, individual drum units 92 are managed, and replacement of drum units 92 is detected. Even if drum units 92 are replaced, a proper life management can be implemented through the processes described in steps S205 to S209.

(C) Other Embodiment

The invention is not limited to the embodiments described above and can be applied to modifications shown in the following examples.

(C-1) In the example of each embodiment described above, the image formation apparatus of the invention is applied to a tandem-type color printer. However, the invention is not limited to the examples and may be applied to apparatuses that include drum units (photosensitive drums), such as copiers, facsimiles, and MFPs including printing functions.

Moreover, in the example of each embodiment described above, the image formation apparatus of the invention is applied to a color printer with toner colors of C, M, Y, and K. However, the invention may be applied to a monochrome printer using only a black toner color. Furthermore, in the color printer of each embodiment described above, life management of the drum units is performed. However, life management of other replacement members contributing to the printing quality (for example, various types of replaceable rollers and blades) may be also managed in the same manner.

(C-2) In the description of each embodiment described above, the color printer is configured to include both MPS drum units and general-purpose type drum units. However, the color printer may be configured to employ only MPS drum units. In such a case, the processes corresponding to the general-purpose type in the first embodiment (steps S102, S103, and S107, for example) and the processes corresponding to the general-purpose type in the second embodiment (steps S301, S302, and S306, for example) may be omitted.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. An image formation apparatus comprising:

an image formation apparatus body; and a replacement member detachably provided in the image formation apparatus body and configured to be used for image formation, wherein the replacement member includes a first storage configured to store a life determination value used in a life determination of the replacement member, and the image formation apparatus body includes:

a connection section configured to be connected to the first storage of the replacement member; and a controller configured to operate in: a first processing mode of accessing the first storage of the replacement member to acquire the life determination value and managing a life of the replacement member based on the acquired life determination value; and a second processing mode of managing the life of the replacement member such that a quality of image formation using the replacement member is higher than that obtained through an operation in the first processing mode, wherein the image formation apparatus body includes a second storage configured to store management information including the life determination value used in the life determination of the replacement member, when the controller fails to acquire the management information from the first storage of the replacement member, the controller sets the life determination value applied to the replacement member to the life determination value acquired from the second storage, the image formation apparatus body further includes an operation reception unit capable of receiving an operation from a user; and when the controller acquires the life determination value from the first storage of the replacement member, the controller starts operating in the second processing mode, uses the operation reception unit to receive an input of the life determination value, and sets the life determination value applied to the replacement member to the life determination value inputted from the user when the life determination value inputted from the user is smaller than the life determination value obtained from the first storage of the replacement member.

2. The image formation apparatus according to claim 1, wherein the first storage also stores an actual use value indicating an actual use of the replacement member, and the controller is further configured to manage the life of the replacement member based on the actual use value in the first storage and the life determination value applied to the life management of the replacement member.

3. The image formation apparatus according to claim 2, wherein the controller is further configured to set the life determination value applied to the replacement member to the life determination value inputted from the user when the life determination value selected by the user is smaller than the actual use value concerning the replacement member, and uses the operation reception unit again to receive an input of the life determination value from the user when the life determination value selected by the user is larger than the actual use value concerning the replacement member.

4. An image formation apparatus, comprising:

an image formation apparatus body; and a replacement member detachably provided in the image formation apparatus body and configured to be used for image formation, wherein the replacement member includes a first storage configured to store a life determination value used in a life determination of the replacement member, and the image formation apparatus body includes:

a connection section configured to be connected to the first storage of the replacement member;

a second storage configured to store a life determination value used for the life determination of the replacement member; and a controller configured to manage the life of the replacement member using any one of the life determination value acquired by using the connection section to access the first storage of the replacement member and the life determination value acquired from the second storage, the controller being further configured to, when the controller successfully acquires the life determination value from the first storage, manage the life of the replacement member based on a value not more than the life determination value acquired from the first storage, wherein the controller is configured to operate in: a first processing mode of managing the life of the replacement member; and a second processing mode of managing the life of the replacement member such that the image formation using the replacement member is performed at a higher cost due to performing image formation at a higher quality than a performance cost resulting from image formation are a lower quality during in the first processing mode, when the controller operates in the second processing mode, the controller is further configured to set the life determination value applied to the replacement member to a value smaller than the life determination value acquired from the first storage, and when the controller fails to acquire the management information from the first storage of the replacement member, the controller is configured to set the life determination value applied to the replacement member to a value not more than the life determination value acquired from the second storage.

5. The image formation apparatus according to claim 4, wherein when the controller operates in the second processing mode, the controller is further configured to set the life determination value applied to the replacement member to a value smaller than the life determination value acquired from the second storage.

6. The image formation apparatus according to claim 5, wherein when the controller operates in the second processing mode, the controller is configured to set the life determination value applied to the replacement member to a value smaller than the life determination value acquired from the second storage.

* * * * *